US005299845A

United States Patent [19]

Gabriel

[11] Patent Number: 5,299,845

[45] Date of Patent: Apr. 5, 1994

[54] AUTOMATICALLY-ACTUATED CARGO-HOOK DEVICE AND MANUAL GUIDANCE SYSTEM FOR SUSPENDED LOADS

[76] Inventor: Edwin Z. Gabriel, 91 Mt. Tabor Way, Ocean Grove, N.J. 07756

[21] Appl. No.: 919,881

[22] Filed: Jul. 27, 1992

[51] Int. Cl.[5] ..... B66C 1/38

[52] U.S. Cl. ..... 294/2; 294/19.1; 294/82.32

[58] Field of Search ..... 294/1.1, 2, 3, 19.1, 294/65.5, 74, 75, 82.24–82.27, 82.3–82.34, 88, 106, 110.1, 118, 86.4

[56] References Cited

U.S. PATENT DOCUMENTS

| | | | |
|---|---|---|---|
| 1,045,680 | 11/1912 | Cronin | 294/19.1 |
| 3,493,259 | 2/1970 | Morgan | 294/74 |
| 3,532,376 | 10/1970 | Munck | 294/74 |
| 4,717,189 | 1/1988 | Gabriel | 294/82.32 |
| 4,943,099 | 7/1990 | Gabriel | 294/82.32 |
| 5,074,608 | 12/1991 | Gabriel | 294/82.32 |

FOREIGN PATENT DOCUMENTS

| | | | |
|---|---|---|---|
| 1411261 | 7/1988 | U.S.S.R. | 294/86.4 |

*Primary Examiner*—Johnny D. Cherry

[57] ABSTRACT

This improved cable-scooping hook device with upper and lower portions and with a pivot pin and hubs is better able to snatch and scoop up a load cable than previous designs. Its tongs-like configuration can have a combination of magnetic hammerheads, weights on top and an extension spring to help force its lower portions, including jaws, to separate, when suspended cargo makes a touchdown onto a platform. To ensure that the load cable is snatched, a bar magnet is suspended from one or both hubs of the pivot pin. A ferrous metal load cable is attracted by the suspended magnet and held in place until the device's jaws close, as a load is lifted by the hoist cables. A person holding a long pole with a hook on its end guides the device to the load cable's location. When the hook reaches the load cable, attached to a load, the device is lowered to make contact with it, whereupon the cable is quickly snatched and scooped up, aided by the magnet's attraction. Another technique is described and illustrated for aiding a non-magnetic cable to be snatched and scooped up.

13 Claims, 13 Drawing Sheets

FIG. 11
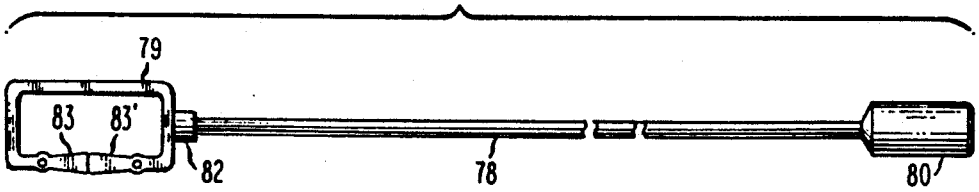
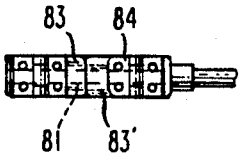
FIG. 12
FIG. 13
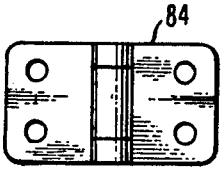
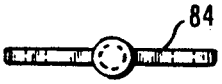
FIG. 14
FIG. 15
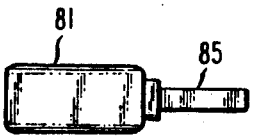
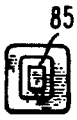
FIG. 16
FIG. 17
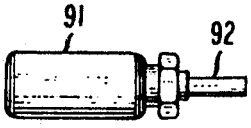
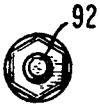
FIG. 18

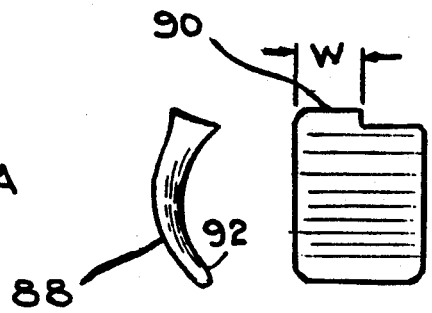
Fig. 24A
Fig. 24B
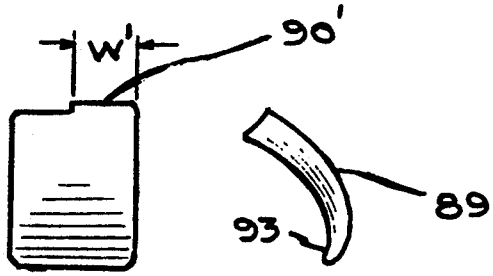
Fig. 25B
Fig. 25A
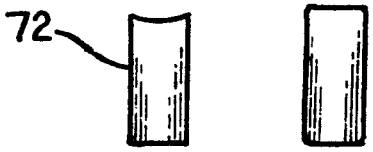
Fig. 26A
Fig. 26B
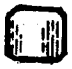
Fig. 26C

AUTOMATICALLY-ACTUATED CARGO-HOOK DEVICE AND MANUAL GUIDANCE SYSTEM FOR SUSPENDED LOADS

BACKGROUND OF THE INVENTION

The background is similar to Background of Invention, U.S. Pat. No. 5,074,608.

This invention is in the field of material handling, primarily related to cargo hooks. A previous U.S. Pat. No. 5,074,608 by Gabriel also describes a tongs-like cable-scooping device having some of the features of the present invention.

In the past, the operation of loading cargo has been a manual one, a hazard to personnel in such situations as loading an off-shore heaving, swaying ship. Ship personnel have had to manually place a ring attached to a cable onto a cargo hook, for cargo to be lifted by a hoist cable and placed elsewhere. In addition, remote unloading has been performed by applying a signal to a solenoid, as in the case of the Breeze-Eastern cargo hook. Should there be an open circuit between the switch and the solenoid, cargo would be incapable of remotely unloading. Should the application be to suspend cargo from a helicopter, a hazardous environmental condition could exist when manually loading cargo. Toxic waste sites also present a hazard for manually loading and unloading of cargo, such as drums. In other hazardous operations, ammunition and toxic chemicals may need to be transported to another site. It would be safer and less time-consuming not to use ground personnel and use the proposed hook instead.

Presently, Breeze-Eastern, Union, N.J., supplies the military with complex cargo hooks, capable of unloading cargo remotely with the application of a signal to a solenoid within the hook enclosure. Unfortunately, none of their cargo hooks can remotely snatch up a load cable. For remote releasing of cargo, the Breeze hook requires 22–28 VDC at 12 to 15 amperes, for release at dropping capacity for a typical 6000-lb. load, and a minimum release load of 7 lbs. for 1⅝ inch travel of the rotatable hook portion, according to their specifications. In comparison,, the proposed cargo-hook requires 1 ampere at the same voltage to produce a jaws' closing force of 10 lbs.

If back-up load retention is not required, then voltage need not be applied to the hook for the electromagnet. The proposed permanent magnets can provide back-up positive load retention.

SUMMARY OF THE INVENTION

A helicopter manufacturer or user of a helicopter may be interested in suspending cargo from a helicopter to transport same to another site. In the past, the loading of cargo has been a manual one, a hazard to personnel performing the manual loading operation. The loading of ships offshore by helicopter also could be a hazard to personnel in the vicinity of the high-velocity downwash of helicopter rotors. The cargo-hook device, illustrated in the drawings, is capable of snatching a load cable without the assistance of ground personnel standing directly under the helicopter's fuselage, to attach a cable to a hook.

Like in U.S. Pat. No. 5,074,608, the device has two elongated members, pivoted near their mid-section by a pivot pin, for use with hoist cables and a load cable, to which cargo can be tied. These members could be longer in size than those depicted in the drawings, in order to be more visible from a distance; a greater separation between said jaws could mean a greater likelihood of the jaw-ends straddling the load cable to be snatched on the first try. The proposed magnets would enhance the likelihood of the hook snatching the load cable sooner and with less effort. The improvements of this hook over the device shown in U.S. Pat. No. 5,074,608, are the following:

1. Addition of an elongated bar magnet, either permanent or an electromagnet, suspended from hub of the device's pivot pin;
2. The addition of slippery Teflon coating to the device's surface, to avoid its getting caught in the branches or limbs of a tree, while suspended from the fuselage of a helicopter;
3. The addition of reflectors on the surfaces of the device to improve its visibility to the operator of the hoist mechanism in either the helicopter or in the derrick's cabin;
4. The addition of luminescent paint to salient surfaces of the device to increase its visibility to the winch's operator as well as to ground personnel; and
5. The addition of a long light-weight pole with a two prong fork attached to its end to enable ground persons to steer the hook over to the load cable's location.

Other features of the hook could be the same as depicted in the drawings of U.S. Pat. No. 5,074,608, and described in its Specification.

BRIEF DESCRIPTION OF DRAWINGS

FIG. 6A is a bottom view thereof, while

FIG. 11 shows a rectangular-shaped enclosure attached to a very long pole having a handle at its end. The enclosure has swinging doors to allow the hoist cable to pass through into the enclosure.

FIG. 12 is a side view of the enclosure without the pole.

FIG. 13 is a front view of one of the hinges.

FIG. 14 is an end view thereof.

FIG. 15 is a side view of a solenoid with a rectangular-shaped plunger.

FIG. 16 is an end view thereof.

FIG. 17 is a side view of a solenoid with a circular-shaped plunger.

FIG. 18 is an end view thereof.

FIG. 24A is a side view of one of two inner smaller jaws, suspended by the device's hub.

FIG. 24B is a front view thereof.

FIG. 25A is a side view of the second of the two smaller jaws suspended vertically by the device's hub.

FIG. 25B is a front view thereof.

FIG. 26A is a front view of a rectangularly-shaped permanent magnet suspended vertically by the device's hub.

FIG. 26B is a side view thereof.

FIG. 26C is an end view thereof.

DESCRIPTION OF PREFERRED EMBODIMENT

Figure 6B:
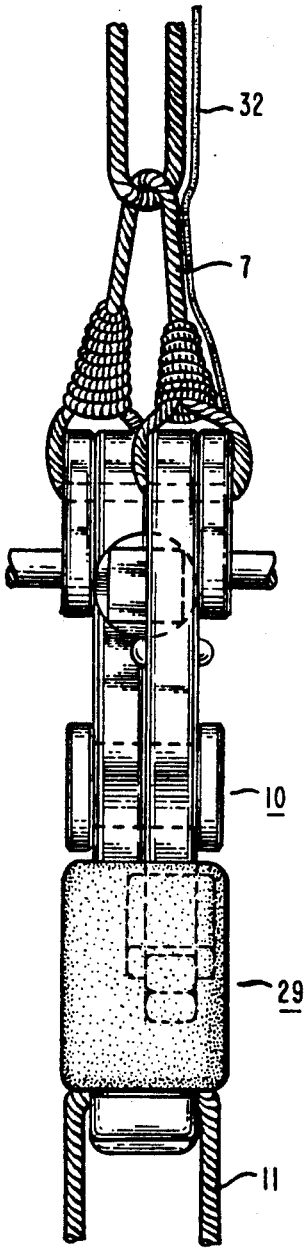
FIG. 6B is a side view.
Figure 6:
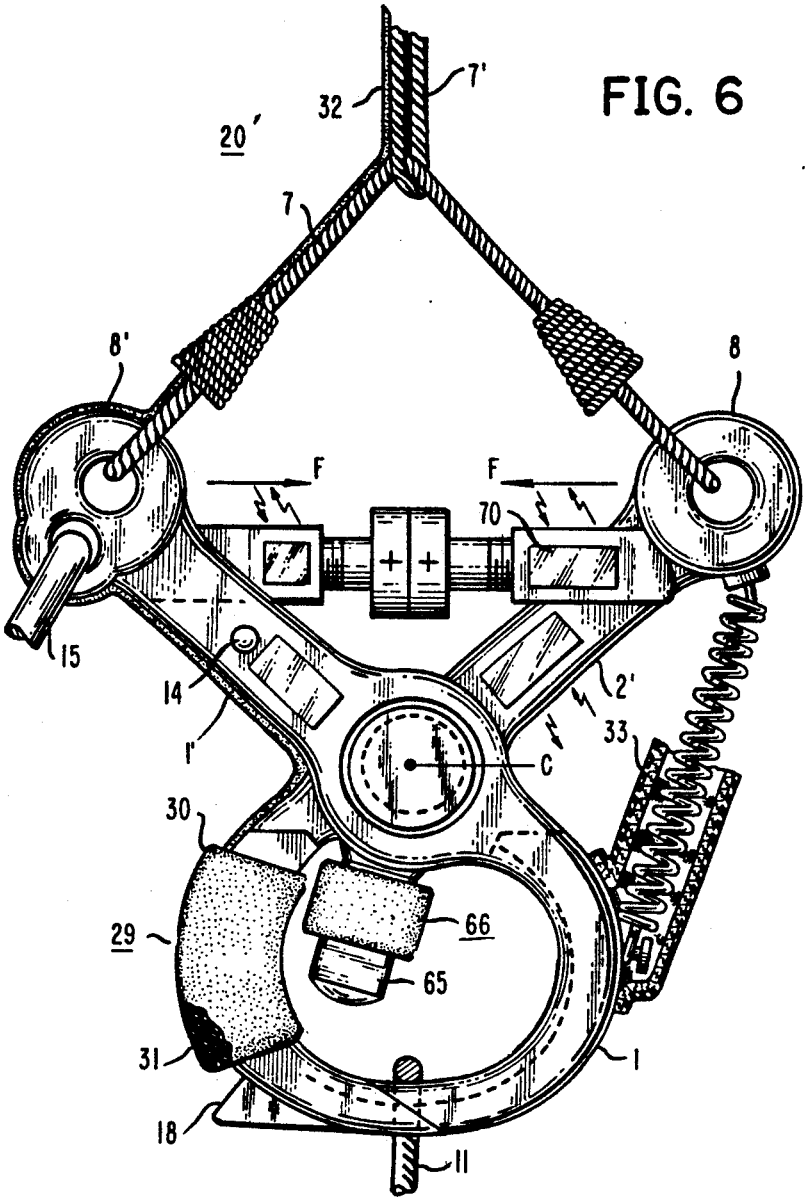
FIG. 6 shows a front view of the assembly of the device with an elongated electromagnet suspended from the pivot pin's hub.
Figure 6A:
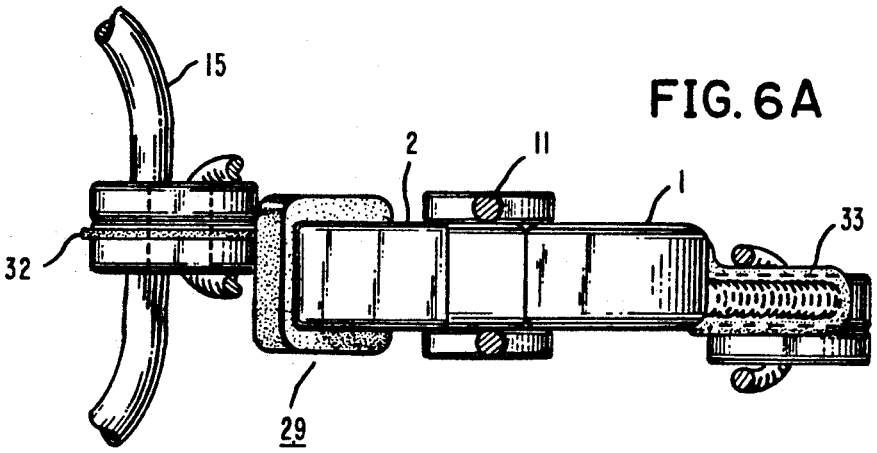
Figure 7:
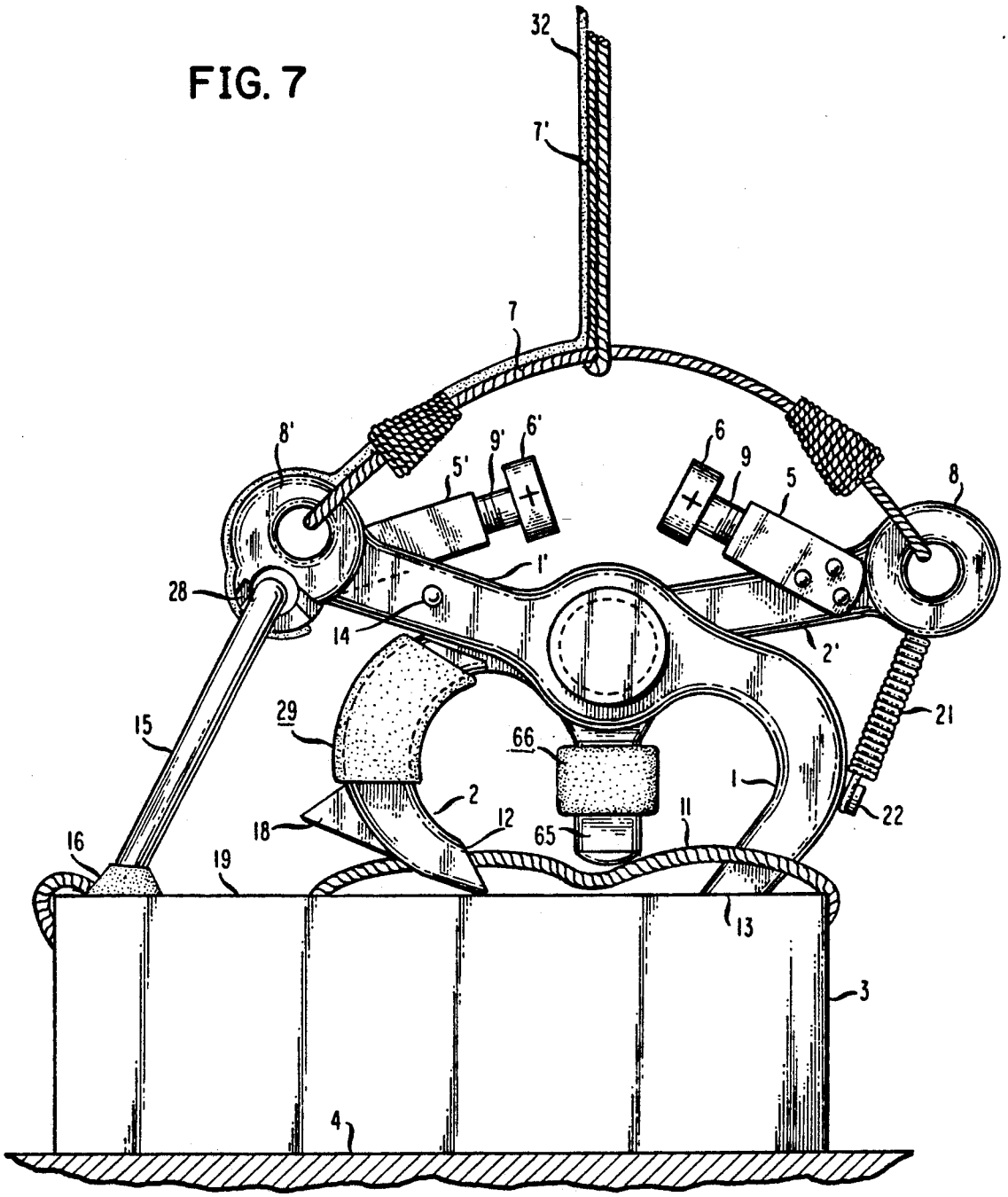
FIG. 7 shows a front view of the assembly of the hook device with its jaws separated and with an electromagnet magnetically attracting a ferrous metal cable attached to a load. The coil wrapped around one of its jaws provides an electromagnetic capability, should positive load retention be required.

Cargo hook device 20' has been improved over device 20, FIG. 6, U.S. Pat. No. 5,074,608, by the addition of an electromagnet 65, FIG. 6. The purpose of magnet 65 is to enable hook 20' to be better able to snatch cable 11 on the first try when lowering hoist cable 7, attached to a winch in helicopter 71. The jaws 1 and 2 of device 20' separate upon the instant cable 7 becomes slackened. The hook would be guided to the location of load cable 11 by pole 68 with a U-shaped tubing 69 at its end, having the appearance of a two-pronged fork. Once the hook is over the cable to be snatched and the hook is lowered on top of it, jaws 1 and 2 separate, and magnet 65 picks up magnetically attractable load cable. Now when cable 7 is pulled upward, cable 11 keeps adhered to magnet 65 as shown in FIG. 7. Cable 11 remains adhered to magnet 65 until the hook begins to lift load 3. Then cable 11 separates from magnet 65, while magnet 65 moves sideways, as shown in FIG. 6. The separation of cable 11 from magnet 65 occurs because weight 3 has greater force than the attraction of cable 11 to magnet 65.

The above improvement would minimize the amount of manipulation that otherwise would be required to place the hook directly above load cable 11 and keep the hook there under high velocity down-wash conditions, with the hook at the end of a 50 to 100 ft. cable. As the hook is being lowered from the helicopter and comes within about 6 ft. of the load cable, a ground person with a long pole 68 with attached two-prong fork 69, moves the fork over to hoist cable 7 and places the cable inside the fork between the two prongs, guiding it so it hovers directly over the load cable. Upon further lowering of cable 7, the hook touches cable 11, and as soon as cable 7 becomes a little slackened, jaws 1 and 2 of hook 20' separate, allowing magnet 65 to grab cable 11 as shown in FIG. 7. Strengths of magnets 6 and 6' can be such that the instant that cable 11 is touched by either jaw 1 or 2 or both, the jaws separate. Instantly, cable 11 is grabbed by magnet 65, which could be either a permanent magnet or an electromagnet. Consequently, when hook 20' is pulled up by cable 7, cable 11 is drawn upward, too.

To produce instant separation of jaws 1 and 2, device 20', three techniques are applied.

1. Weights 8 and 8' on top;
2. Tension spring 21, FIG. 7;
3. Poles of permanent magnets 6 and 6' facing each other to be of like polarity to produce a repelling force.

The least expensive technique is utilizing the tension spring approach to force separation of jaws 1 and 2, when the instant device 20' makes contact with a surface below.

No harm would occur if spring 21 should become ineffective, should it be the only technique used to separate jaws 1 and 2, upon touchdown, the result being that jaws 1 and 2 would not separate to allow cable 11 to be released.

If weights 8 and 8' were used, too, then separation of jaws 1 and 2 could be assured, even if spring 21 were damaged or broken.

Figure 1:
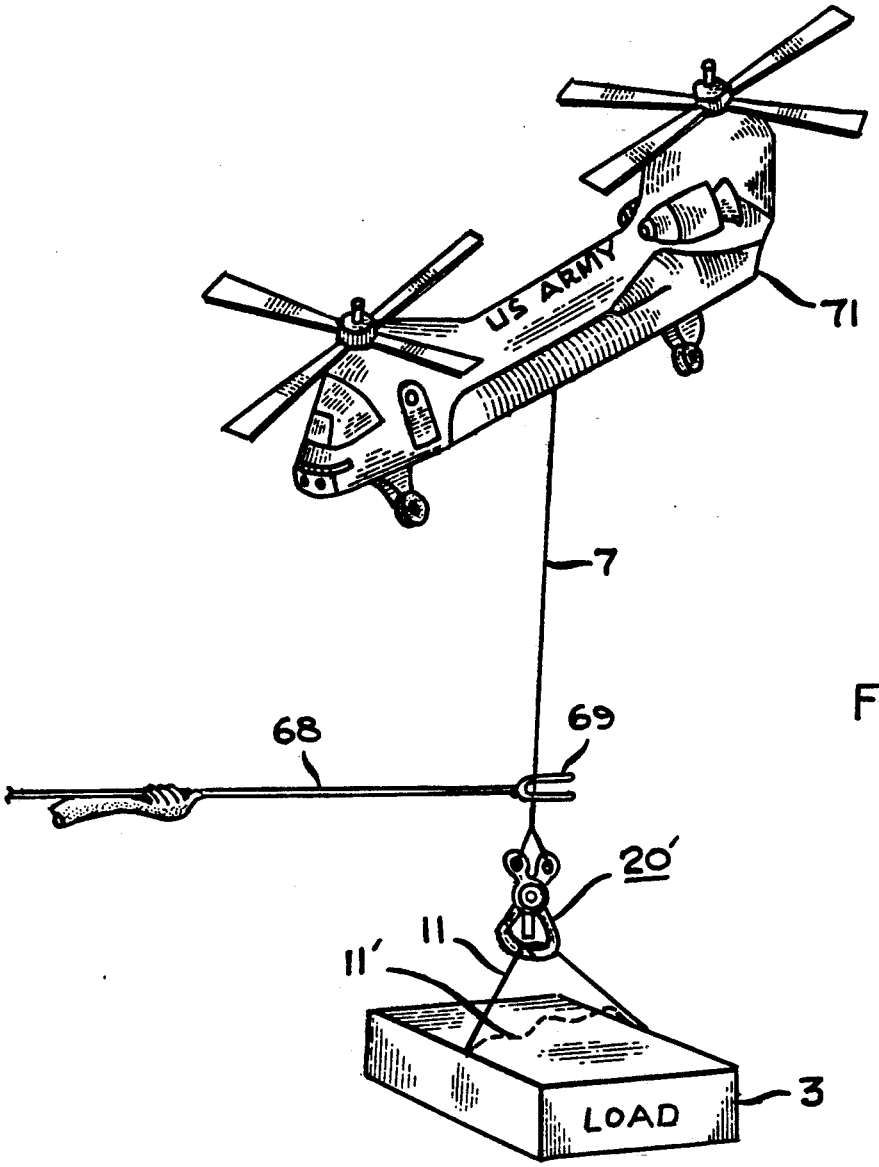
FIG. 1 shows a helicopter hovering over a load whose hoist cable is attached to a winch at the copter's underneath. A cargo-hook device is attached to the hoist-cable end. A cargo's load cable has to be snatched by the hook device, which has been guided by a two-pronged fork on a long pole to a position directly over the cable to be snatched.

To ensure that minimum manipulation would be required to successfully and quickly engage a load cable, in the environment of a hovering helicopter, where high velocity down-wash exists, with hook 20' at the end of a 50 ft. or longer cable, in addition to a long pole with attached fork, device 20' itself could be made more visible to the operator of the aircraft's hoist mechanism, as well as to the person handling long pole 68, FIG. 1.

The hook could be painted with luminescent paint and also be provided with reflectors 70. LEDs 14 on both sides of device 20' illuminate and provide visibility at night and on cloudy days.

Then, the winch's operator may be concerned about the possibility of device 20' being caught in branches of trees. To reduce this possibility, the hook's surface could be coated with slippery, stable Teflon, to enable it to slip out of tree limbs, etc., if accidentally caught.

Figure 8:
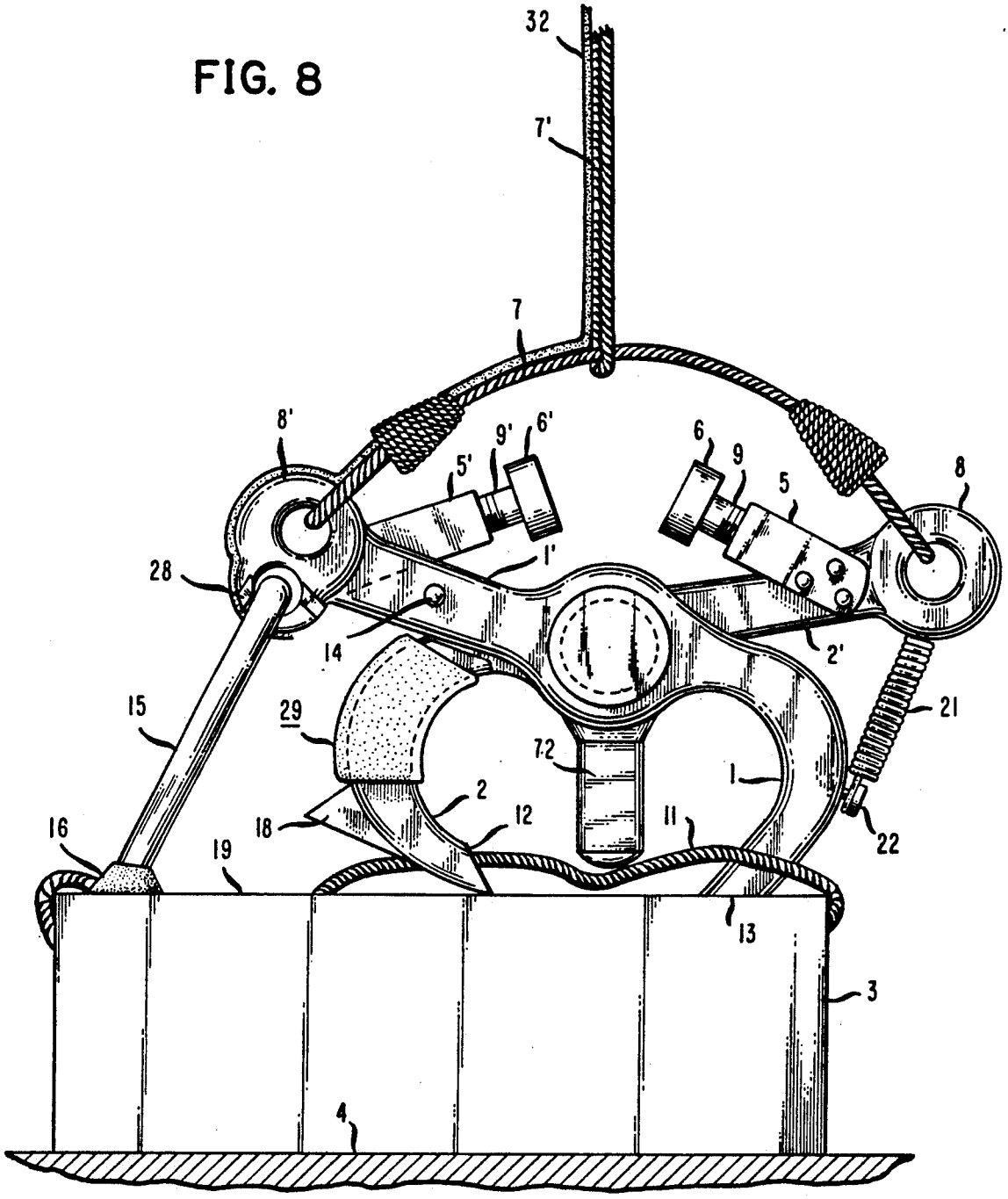
FIG. 8 shows a front view of the assembly of the device with an elongated permanent magnet suspended from the pivot pin's hub. The hook's jaws are separated as in FIG. 7.

FIG. 8 device 93 shows a front view of device 20' with an elongated permanent magnet 72 attached to the pivot pin's hub, as shown. The magnet is shown protruding vertically downward with jaws 1 and 2 completely separated. Coil 29 and jaw 2 are desirable when positive load retention is required when lifting a load and jaws 1 and 2 are engaged, as shown in FIG. 6.

If a permanent magnet is used, its strength should be tested to be sure that it has not been demagnetized. If demagnetized, the magnet should be re-magnetized using the proper procedure for doing so.

Figure 5:
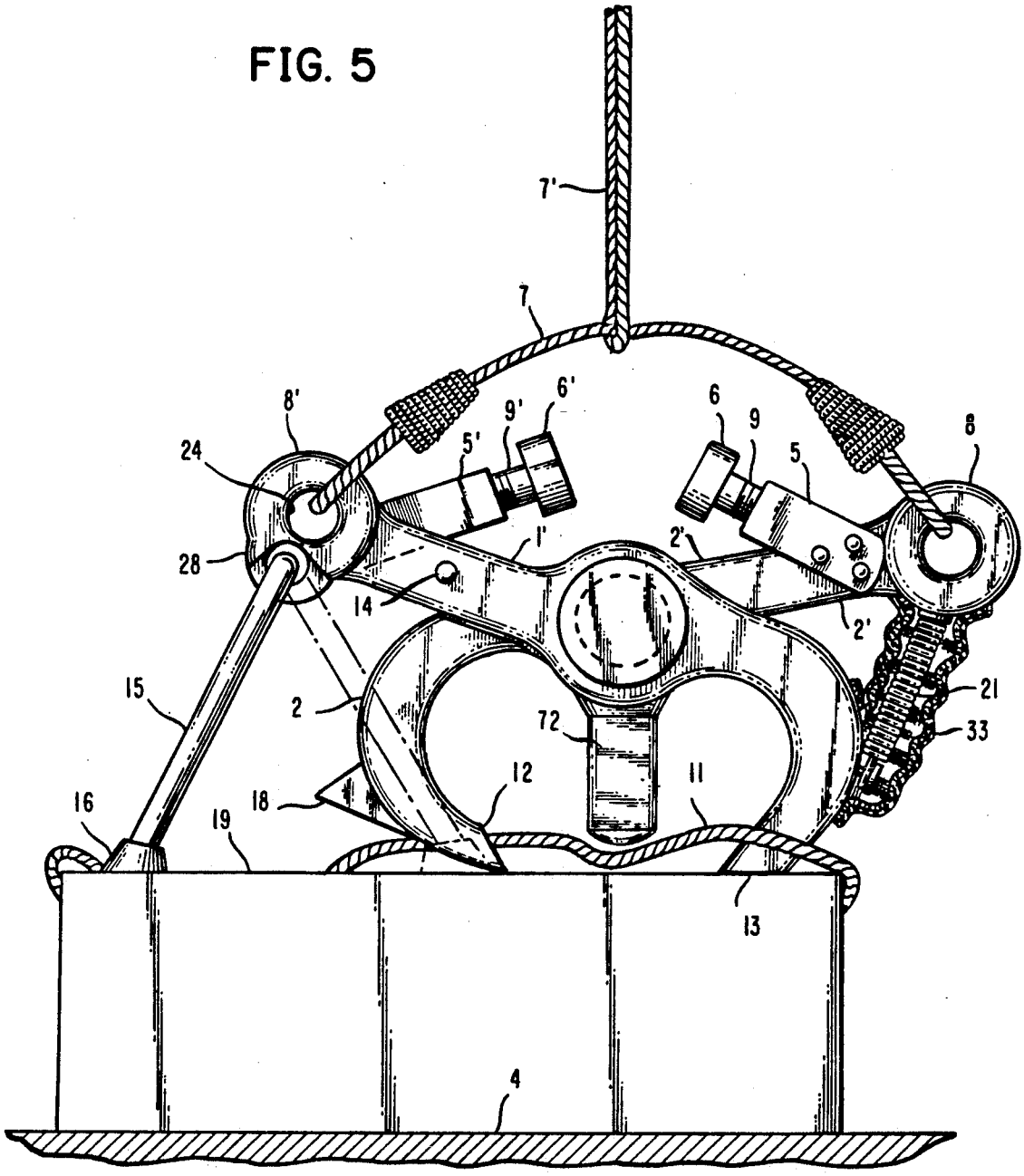
FIG. 5 shows a front view of the device's assembly with its jaws completely separated and with a bar magnet magnetically attracting and making contact with a ferrous metal cable attached to a load. This same view could have shown two bar magnets attached to the undersides of the pivot pin hubs, such that they would be aligned.
Figure 9:
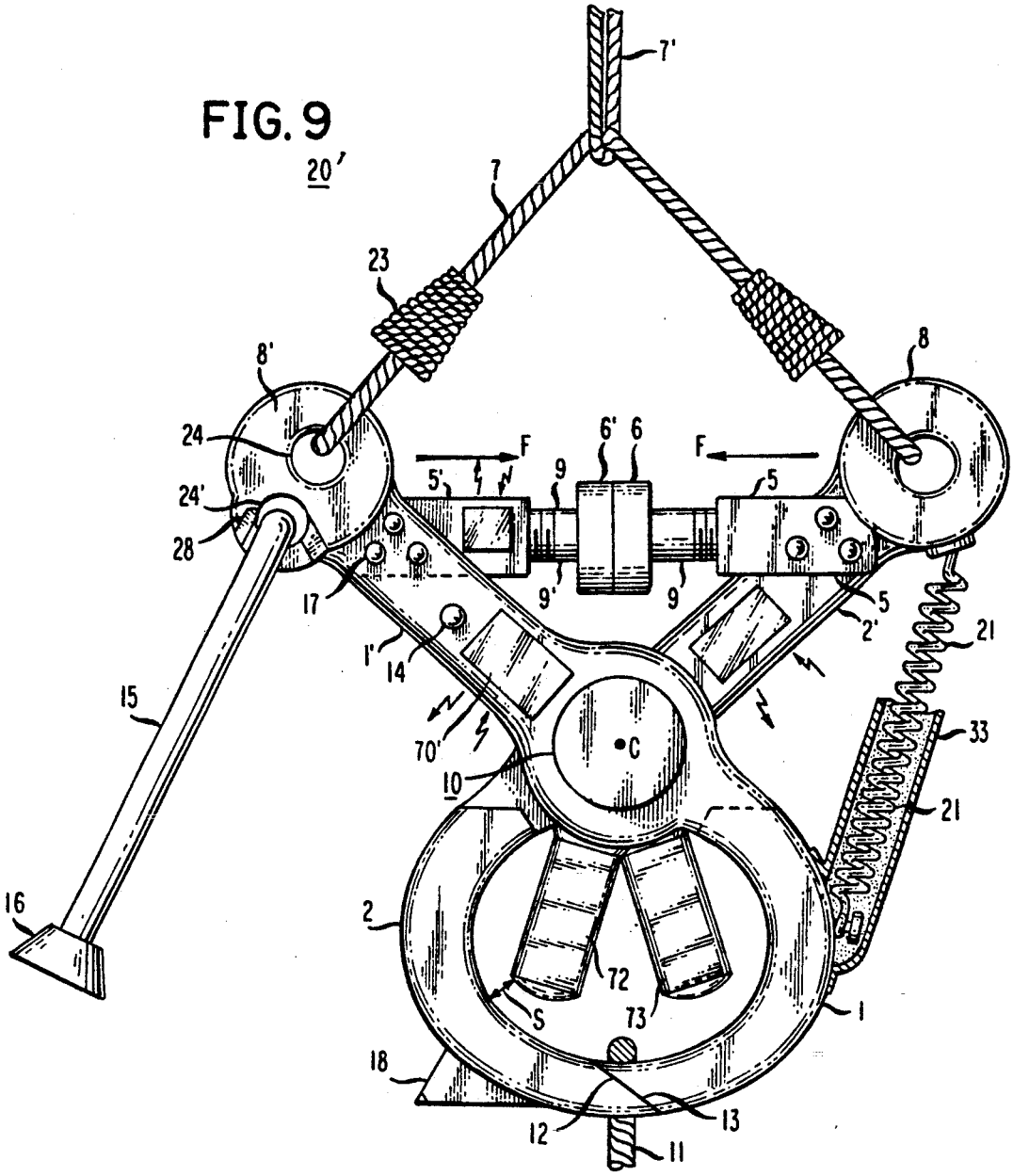
FIG. 9 shows a front view of the device's assembly with its jaws engaged and with two permanent magnets attached to the undersides of both pivot pin hubs, one elongated magnet firmly attached to one of two hubs. When device's jaws are engaged, the magnets form an upside down V, as shown. The coil wrapped around one of the jaws provides electromagnetic capability, should positive load retention be required.
Figure 10:
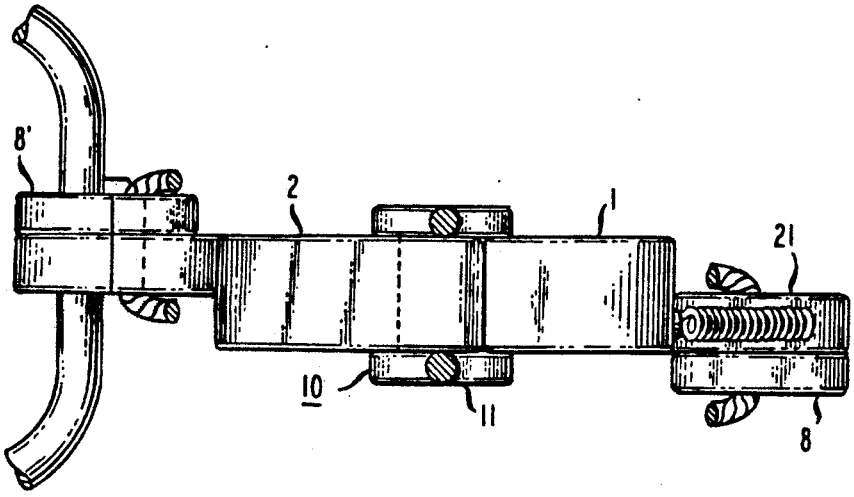
FIG. 10 is a bottom view thereof.

A single bar magnet with its end magnetized has been shown in the previous assembly drawings, that single magnet being attached to one of the two rotating hubs. To be more certain that the load cable will be attracted by the magnet, another magnet is attached to the second rotating hub, as shown in FIG. 9 device 20. Now, as the two magnets align, when jaws 1 and 2 are separated as shown in FIG. 5, the magnetic force of attraction for cable 11 is doubled, and it is more certain that cable 11 will be picked up by the hook 20, when its jaws are placed over cable 11.

Even without the back-up positive load retention of an electromagnet, the presence of permanent magnets 72 and 73, mounted as shown in FIG. 9, could provide that capability. Thus, should hoist cables 7 and 7' slacken, because of making contact with tree limbs, the load cable might loosen and jump up. In so doing, load cable 11 could be caught by the permanent magnets, and held there until tension is restored in hoist cables 7 and 7'.

Reflectors 70, 70', shown in FIGS. 6 and 9, would assist in locating the hook's presence at dusk or at night-time loading operations.

The advantage of using an electromagnet 65 over a permanent magnet 72 is that remote and automatic release of load cable 11 is more likely. The procedure for releasing cable 11 from the hook is described in U.S. Pat. No. 5,074,608. With permanent magnets 72 and 73 in place, load cable 11 could be pulled away from device 20' manually. A pound or two of force could be all that is necessary to remove cable 11 from permanent magnets 72 and 73, were cable 11 adhered by an attraction force to the magnets.

If electromagnet 65, FIG. 6, is used, coil 29 may not be necessary for positive load retention of cable 11. Electromagnet 65 may perform that capability, if designed with sufficient magnetic strength, particularly if two bar electromagnets were used, one attached to each of two pivot pin hubs.

Figure 3:
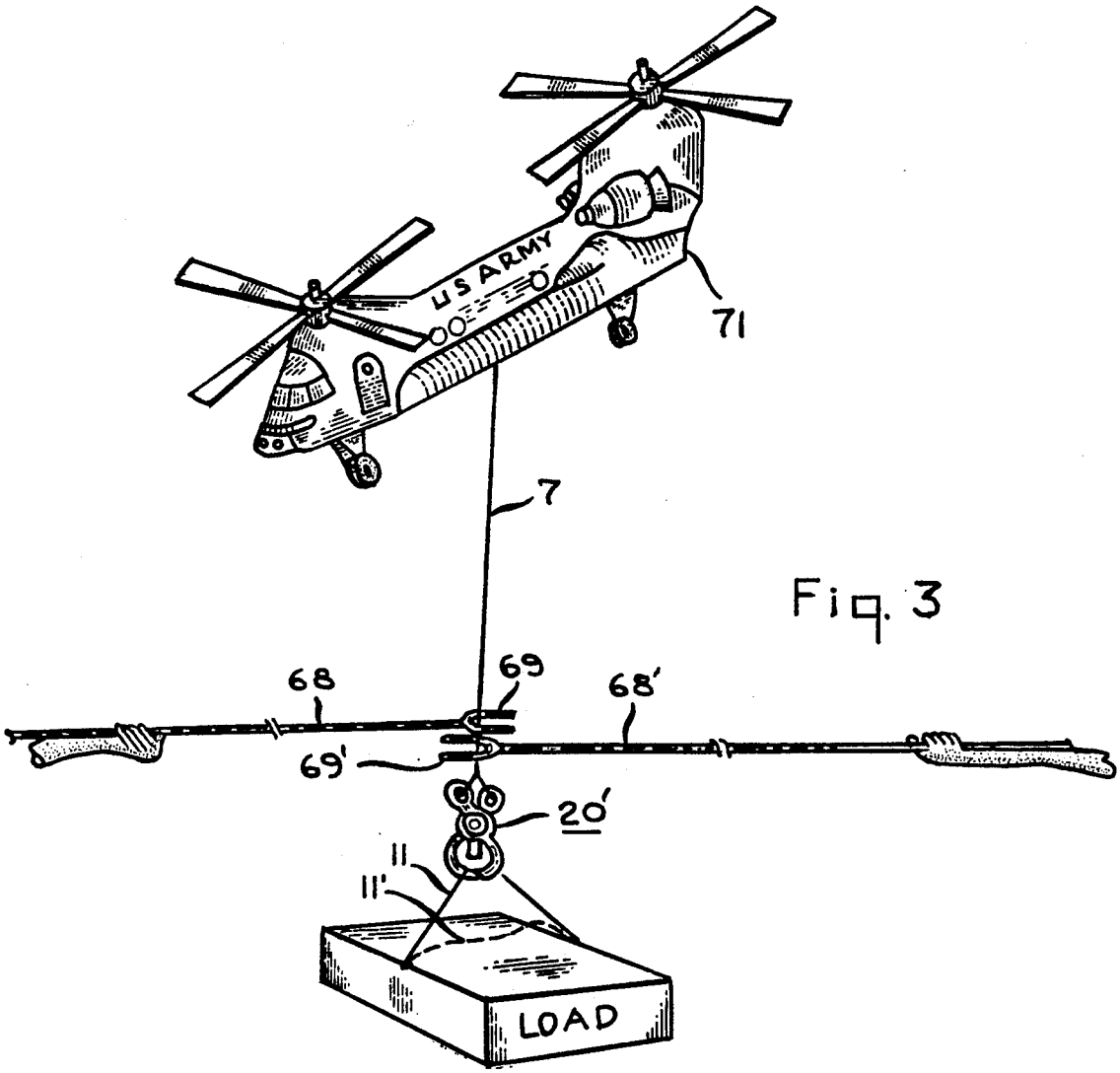
FIG. 3 shows the same hovering helicopter as in the previous figure except two long poles with forks attached to their ends guiding the hoist cable and cargo-hook over the cable to be snatched.
Figure 4A:
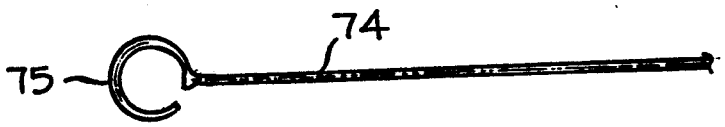
FIG. 4A shows a long pole with a hook attached or formed at its end, as shown, to guide the hoist cable and cargo hook.
Figure 4B:
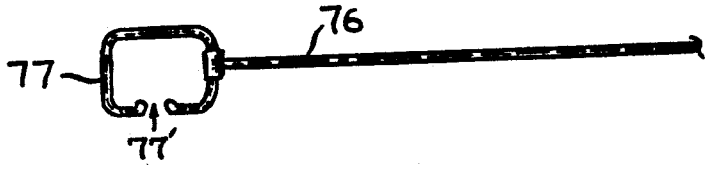
FIG. 4B shows the same long pole with a rectangular-shaped tubing, having an opening on its side, for guiding the hoist cable and cargo hook over to the load cable's location.

Previously, a means for guiding cable 7 over the load cable was described using a very long pole with a two-pronged fork attached at its end, as shown in FIG. 1. A fork can push cable 7 in three directions. The fork's fourth direction is open. Hence, a second pole would be necessary, as shown in FIG. 3, to provide movement of cable 7 in the fourth direction. FIGS. 4A and 4B show alternate shapes of tubing attached to the end of poles 74 and 76 to enable a person to move a hoist cable in all four directions. FIG. 4A shows a hook 75 for engaging cable 7, which may take a little more effort to engage than fork 69 because of the smaller opening. FIG. 4B, shows rectangular configured tubing 77 with an opening 77' on its side for engaging cable 7. This rectangular configuration, too, will take a little more effort to engage cable 7 than fork 69, the amount of effort depending on the size of opening 77'.

A technique similar to that shown in FIGS. 4A and 4B but providing a larger opening on its side 77', FIG. 4B is shown in FIGS. 11 to 14. Here two spring-loaded gates or gates which swing both inwardly and outwardly, 83 and 83' are shown.

Referring to FIGS. 1, and 3, poles 68 and 68' with 2 pronged forks are used to guide the hoist cable to the load cable's location. There is always the possibility that the hoist cables could escape from the open end of the fork. To reduce this possibility, the rectangular configuration of FIG. 11 is presented.

FIG. 11 shows light-weight channel 78, as the long pole of FIG. 1, rectangular metal or reinforced plastic enclosure 79, with solenoid 81, collar 82 and swinging doors or gates 83 and 83'. In the side view, FIG. 12, hinge 84 is shown. Shown by itself in plan view, FIG. 13, is one of the spring-loaded, light-weight hinges capable of swinging both inwardly and outwardly. Coil springs inside barrel 84 provide the hinge's ability to return to the position shown in FIG. 13, after being deflected by the doors or gates 83 and 83', FIG. 11, moving inward or outward. The gap between metal swinging doors 83 and 83', FIG. 11 should be extremely small. Either door or gate 83 and 83' accommodates a push-type solenoid 81 having a rectangular plunger 85 and a rectangular hole or a circular plunger 92, FIG. 18, and a circular hole to accept the plunger when extended, by the application of voltage to its coil. Channel-sectioned pole 78 is preferred because of its resistance to bending compared to a tubular pole. Collar 82 connects channel 78 to rectangular enclosure 79 FIG. 11. A rechargeable battery 86 is enclosed within handle 80 to supply the voltage and current to activate solenoid plunger 85 when a switch 87 on handle 80 is closed, FIG. 22. Enclosure 79 provides positive cable-retention means.

By plunger 85 extending into a properly-shaped hole in the opposite door, doors 83 and 83' are maintained closed to trap hoist cable 7 within enclosure 79 FIG. 11. Thus, the person holding channel 78, FIG. 11, by handle 80, can guide hoist cable 7 over to the load cable's location, while standing away from Helicopter 71's down-wash. Pole 78 should be made of lightweight metal, such as aluminum.

Figure 22:
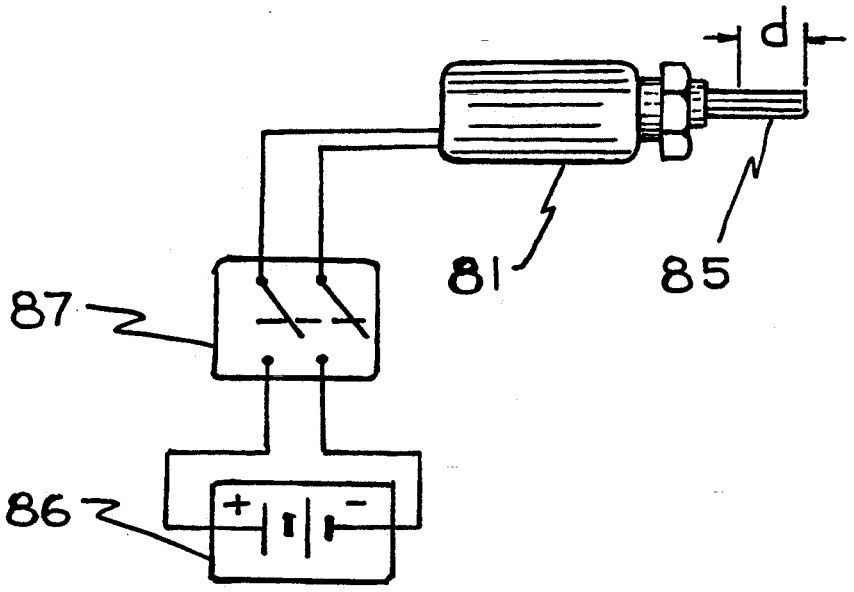
FIG. 22 shows the wiring for the activating and energizing the solenoid, including a double pole switch and a battery as the source of energy.

When switch 87, FIG. 22, open-circuited, solenoid's plunger 85 retracts to its normal position by a coil spring within the solenoid's enclosure. When switch 87 is close-circuited, plunger 85 or 92 extends out to engage the hole in the opposite door or gate. An alternate solenoid design would make an extended plunger 85 or 92 its normal, switch-off position, and a retracted plunger 85, its position with switch 87 turned "on". The amount of swaying hook 20 dangling from a 100 Ft. hovering helicopter could be great, particularly under windy conditions. The fork's purpose is to keep the hook from swaying while providing cable-retention. FIGS. 17 and 18 show a solenoid 91 with a circular-shaped plunger 92, as a substitute for solenoid 81.

In the previous techniques for snatching the load cable, bar magnets were used. If the cable is not magnetically attractable, then the magnet cannot draw the cable to itself. Another technique is needed to pick up a nonferrous cable. The proposed technique is using a forceps-like approach to prepare the cable pick-up using two inside smaller jaws, 88 and 89, shown in FIGS. 19 and 21. Jaw 88 is attached to the hub of lower portion 1, while jaw 89 is attached to the hub of lower portion 2. When lower portions 1 and 2 separate, jaws 88 and 89 come together to grab cable 11, FIG. 21. When lower portions 1 and 2 come together, jaws 88 and 89 separate as in FIG. 19. This approach may require more pinpoint positioning of the device shown in these figures than using one or more bar magnets. In the case of magnets, the cable would jump up to become attached to the magnet. Here, the jaw ends of jaws 88 and 89 must be able to scoop up cable 11 and thus prepare device 94 to be better able to snatch cable 11 upon closing as in FIG. 21. Widths of jaws 88 and 89 are equal to the widths of lower portions 1 and 2. However, only half of width T, FIG. 20, would be holding jaws 88 and 89 in place, because the hubs of pin 10 to which jaws 88 and 89 are attached are half the width of distance T, FIG. 20. Jaws 88 and 89 could be fabricated of either metal or plastics, because the only weight jaws 88 and 89 would be picking up is the weight of cable 11, not including the load or cargo. The ends of jaws 88 and 89 could have a coating of sticky substance to enable cable 11 to adhere to the jaws until lower portions 1 and 2 come together. Once lower portions come together or in the process thereof, cable 11 could slip off of the ends of jaws 88 and 89 and still be captured by jaw ends of lower portions 1 and 2. Legs 15 of the device shown in FIGS. 19 to 21 help keep the device upright until the hoist cable is pulled upward by a winch in a hovering helicopter.

To release cable 11 from the device, the device is lowered onto a platform. Upon making contact or touchdown, lower portions separate. While these portions are partially separated, one need only pull up the device quickly and the cable 11 will be released from jaws 88 and 89.

It should be pointed out that the space inside the lower portions 1 and 2 has been enlarged to allow the addition of jaws 88 and 89.

Figure 23:
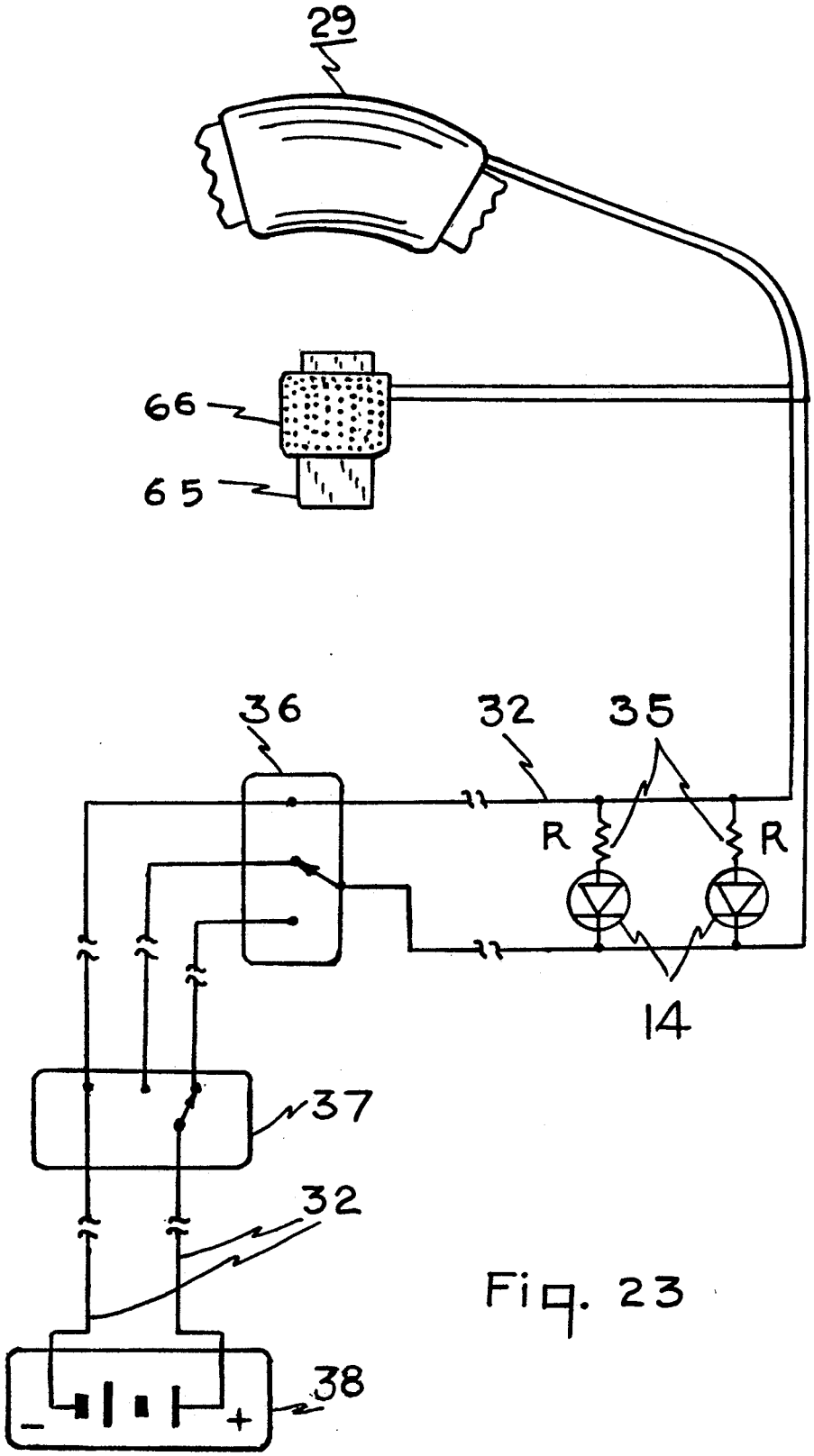
FIG. 23 shows a wiring diagram for energizing both the electromagnets and the LEDs of the cargo-hook device.

FIG. 23 is an electrical schematic of the circuitry for electromagnetic components 29 and 65, shown in FIGS. 6 and 7, in which DC voltage source 38 is the sole energy source for energizing the components. However, it should be mentioned that electromagnet 29 may be unnecessary for back-up load retention with the presence of magnet 65, particularly if two bar magnets 72 and 73 FIG. 9, were used. Bars 72 and 73, FIG. 9, could be provided with coils, assuming they were soft iron or steel. Now should device 20' hit a tree limb, causing cable 11 to loosen or become slack, cable 11 would be grabbed by magnet 65, thus preventing cable 11 from slipping out of any gap that may occur between jaws of lower portions 1 and 2. When using soft iron and coils, magnets 72, 73 could become electromagnets. Switch 37, for energizing the electromagnets, could be located in the winch operator's cabin while switch 36 could be located where convenient for ground personnel to operate. Light-emitting diodes (LEDs) 14, which illuminate the front and rear of device 20' when coil 66 is energized, are shown connected in series with resistors 35 across wires 32 and 32'.

Figure 2:
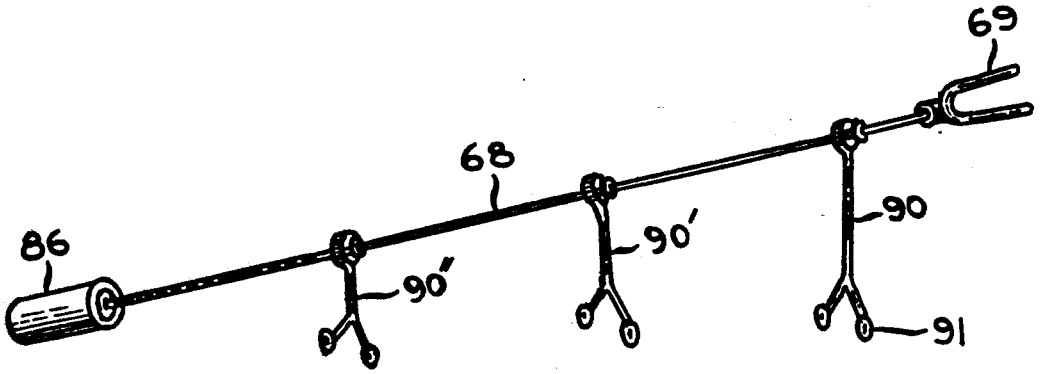
FIG. 2 shows supports for the pole.

To reduce the amount of weight a person may have to lift, long pole 68 could have lightweight plastic supports 90, 90', 90" that could collapse if heavier weight were imposed on them than the pole. The supports would enable the pole to be made of lighter weight material and be made less sturdy than a pole's construction would need to have been if no supports were provided. The lightweight supports would be swivelly attached to the pole and still stay in position horizontally. Hence, there would be less lifting of pole 68 by the person guiding the pole at handle 86, FIG. 11 and FIG. 2. Supports 90, 90', 90", could be fitted with lightweight plastic wheels 91 to enable movement of pole 68 with ease by an individual. The support 90 closest to fork 69 would be the longest in height while the one closest to handle 86 would be the shortest in height. Thus, less lifting would be required, if any, by the individual holding handle 86. Plastic wheels are available from baby carriage manufacturers. Plastic molding firms could supply the supports.

Figure 20:
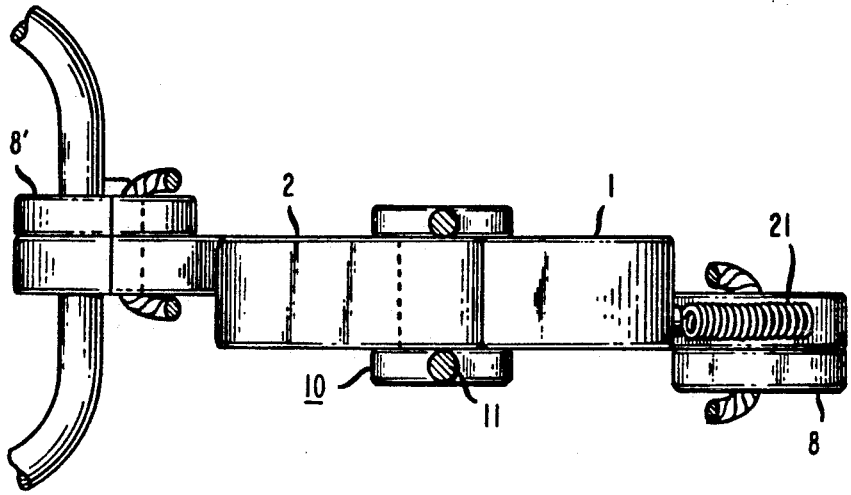
FIG. 20 is a bottom view thereof.
Figure 21:
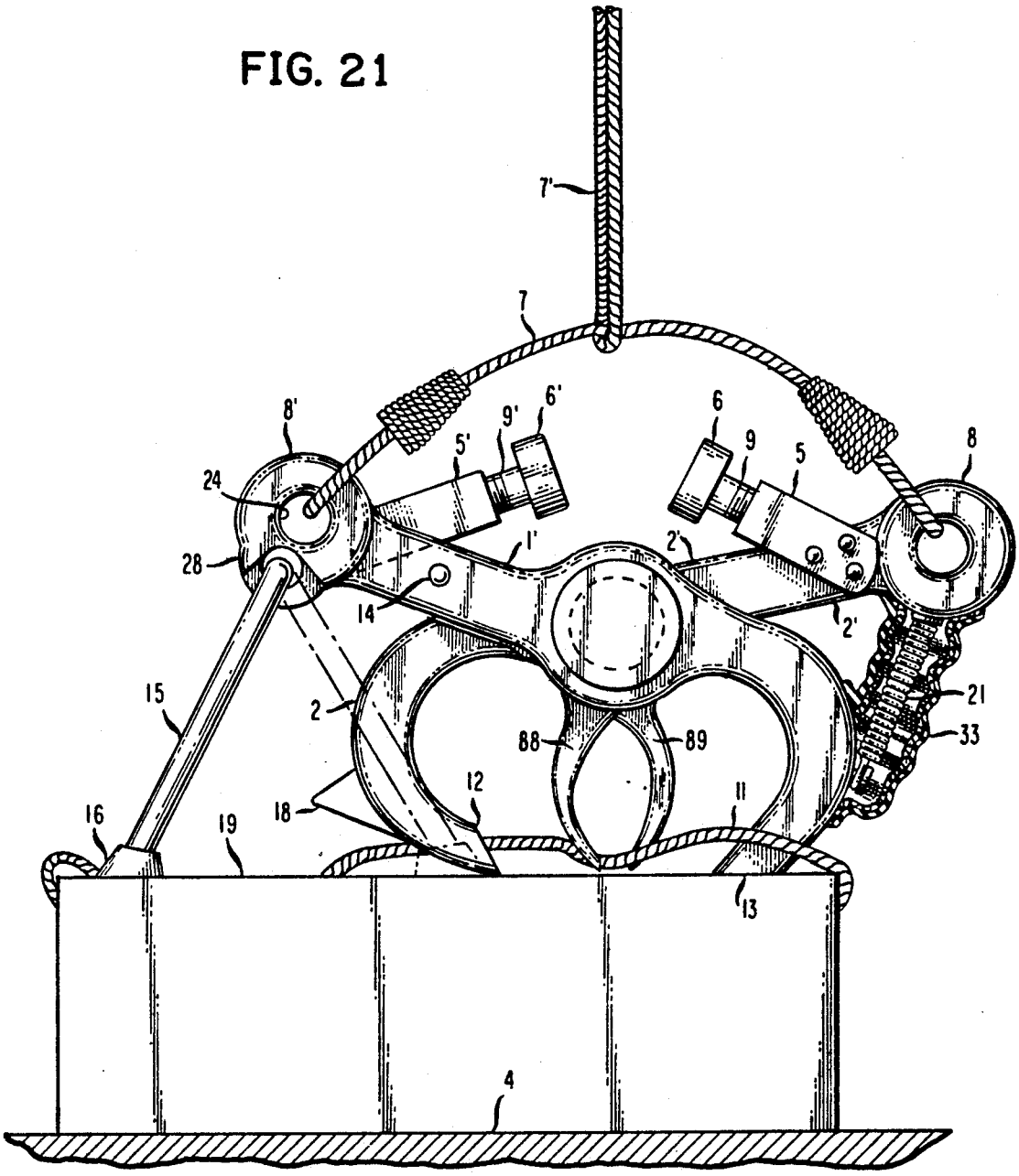
FIG. 21 is a front view of the device with its lower portions separated and the two smaller jaws inside almost making contact; thus enabling the load cable to be picked up. The curvature of the smaller jaws can be greater than that shown on the figure, and their ends touching, to be more effective in scooping up and lifting the cable.

In FIGS. 20 and 21, device 20 is shown attached to hoist cables 7 and 7'. Hand-spliced eyes and thimbles 23 are shown. An off-the-shelf shackle could have been mounted in hole 24, FIG. 21, instead of eyes and thimbles.

Figure 19:
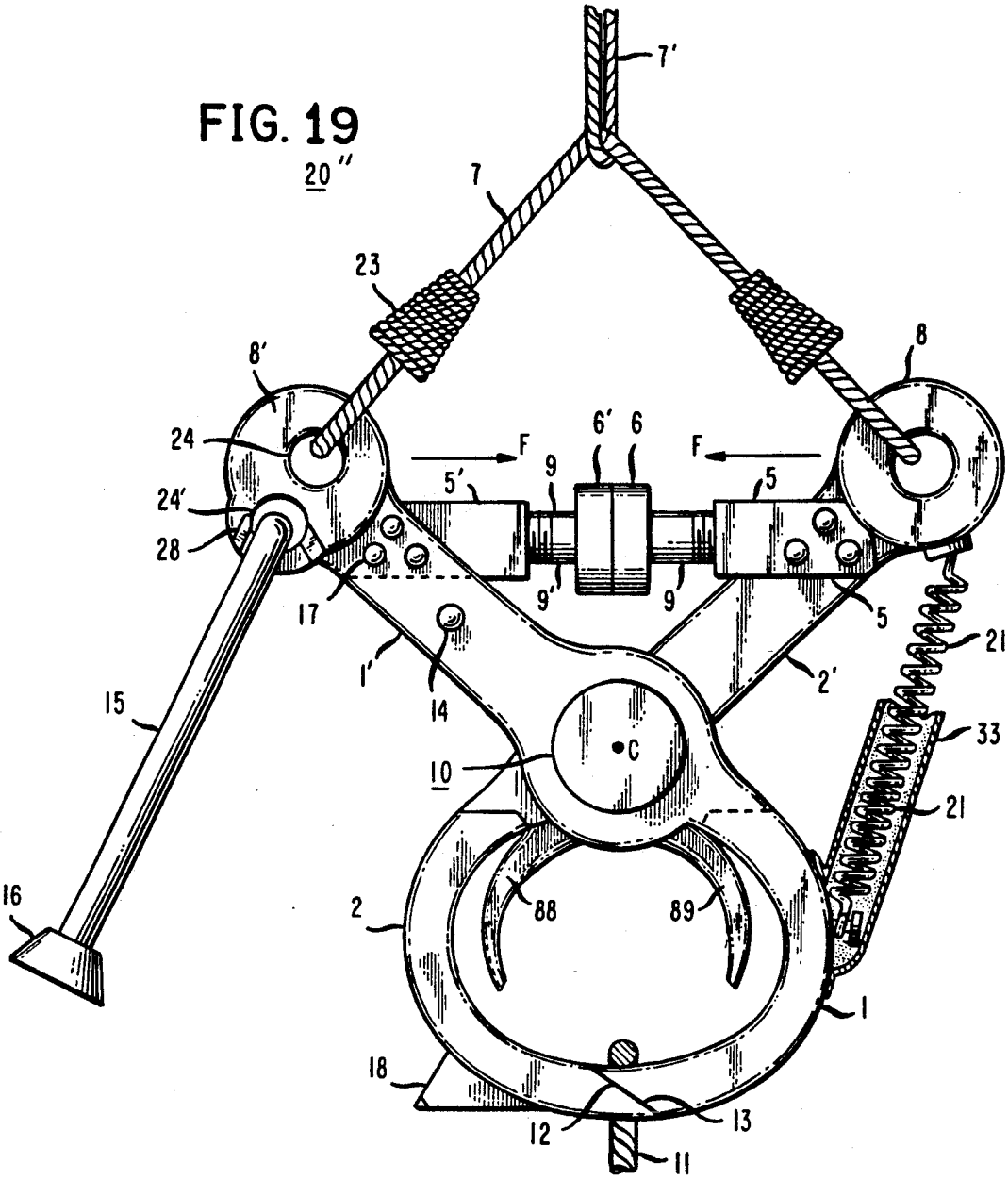
FIG. 19 is a front view of a cargo-hook device showing the addition of two smaller jaws inside the lower portions, to perform the initial snatching of the load cable.

Hole 24', FIG. 19, has been provided for tubular member 15, so member 15 would not interfere with cable 7. The strength of the tubular member or inverted U-shaped standard 15 need be only such as to support device 2& and any dynamic force encountered upon impact on a rigid surface in preventing device from toppling over on its side. Member 15 is capable of swiveling inside of hole 24' and is restrained from moving beyond stops 28.

Extension spring 21, with one end attached to upper portion 2' and its other end attached to the outer surface of portion 1, assists in separating lower portions 1 and 2 upon touchdown of load 3, FIG. 3. Spring 21, FIGS. 19 and 21, can be protected from dirt, moisture and debris by having fabric sleeve 33 fastened tightly to the underside of weight 8 at one end and to the exterior of portion 1 at its other end. Flexible, light-weight sleeve 33, treated to be impervious to water, could be fastened air tight at its ends to the device's structure, so as to have the spring's coils protected from mud, small rocks, dirt and chemicals.

The advantage of the spring over the weights on top is the spring's independence of the force of gravity. Even when the hook may be lying flat on its side on a rigid surface, spring 21 could be keeping lower portions 1 and 2 apart, so either bar magnet 72 or electromagnet 65 could be attracting load cable 11 to itself. If cable 11 is attracted to magnet 65, then the hook would retain the cable within its lower portions while the hoist cable is being pulled up and hold it while lower portions 1 and 2 close together. When the force of load 3 comes into play, then cable 11 would detach itself from the magnet and be supported by jaws 12 and 13 of hook 20', FIGS. 19 and 21. The magnet has a further role to play as a positive-load-retention device should lower portions 1 and 2 accidentally separate such as by the device being caught in tree limbs. Even as the jaws disengage, because of the hoist cable's slackening, cable 11 would be attracted to the magnet and be prevented from being released, along with retaining load 3.

FIGS. 24A and 24B are the front and side views of one of the smaller jaws, while FIGS. 25A and 25B are front and side views of the other smaller jaw.

In side view, FIG. 24B, the portion of width w would be firmly fastened to the underside of one of the pivot pin's hub, while side view, FIG. 25B, the portion of width w' would be firmly fastened to the pivot pin's other hub.

FIGS. 26A, 26B and 26C are front, side and end views of permanent magnet 72. Note from FIG. 26C, that magnet 72 is rectangular in cross section. The other magnets, including the permanent and electromagnets, also have rectangular cross sections.

Inner jaws 88 and 89 may have a sticky substance added to their lower inside surfaces 92 and 93, FIGS. 24A, 25A, to assist in their picking up a cable and holding onto it, while outer jaws, the main jaws, 1 and 2, are coming together upon lift-off of the device and load 3, FIG. 21, from platform 4. It would be desirable to apply a gooey, sticky substance to inside surfaces 92 and 93 of jaws 88 and 89, which would stay on permanently, while temporarily sticking to cable 11. A gooey substance that cures soft, sticky and resilient could be obtained from several chemical producers, such as duPont and Minnesota Mining/Manufacturing.

I claim:

1. A tongs-like cargo-hook device for quickly scooping up and releasing suspended cargo automatically from a platform having a rigid surface, comprising a tongs-like part for use with a hoisting mechanism, said tongs-like part having two elongated members, two hubs and a pivot pin for pivoting each of said elongated members approximately midway, and having an inner surface said hoisting mechanism having hoist cables and a steel load cable, each hoist cable being adapted for attachment to said tongs-like part, said elongated members having two upper portions each having an inner surface and two lower portions, each of said upper portions having weight on top to assist in forcing the separation of said portions upon touchdown of said cargo upon said platform; said lower portions, including main jaws, having complementary-shaped, beveled jaw-ends which close against each other, end-to-end, to form a smooth continuous contour when supporting said cargo, because of the tension on said hoist cables; each of said upper portions having an inside surface with a bar fastened horizontally to each said inner surface, each bar having a hammerhead at one end, and each said hammerhead extending inward toward the other, said hammerheads when abutting sharing the structural stresses imposed on said complementary-shaped ends when supporting said cargo; wherein the improvement comprises the addition of a bar magnet of predetermined strength, attached vertically to the underside of a first of said hubs, whereby when said jaws are completely separated from each other, such as at touchdown, said magnet's lower end, when said jaws straddle said load cable, attracting and making contact with said load cable and holding onto said load cable until said jaws close upon liftoff of said device, thus said jaws lifting up said load cable prior to said jaws closing making the task of scooping up a cable much easier.

2. A tongs-like, cargo-hook device in accordance with claim 1, and wherein said bar magnet is an electromagnet with a coil, having voltage supplied to said coil from a voltage source, having sufficient energy to activate said bar magnet and having magnetic lines of force to attract and lift up said load cable, when said load cable is within a selected distance from the lower end of said bar magnet.

3. A tongs-like, cargo-hook device in accordance with claim 1, and wherein a second bar magnet is attached to the underside of a second of said hubs, said second magnet having a substantially vertical position when said jaws are completely separated from each other, such as when resting on a rigid surface, said second magnet substantially doubling the magnetic force attracting said load cable, to hold onto said load cable until said jaws close together, upon liftoff of said cargo thus making the task of scooping a cable still easier.

4. A tongs-like, cargo-hook device in accordance with claim 3, and wherein said first and second bar magnets are electromagnets with coils having voltage supplied to said coils from a voltage source.

5. A cargo-hook device in accordance with claim 1, and wherein each of said upper and lower portions has an exterior surface and wherein the improvement for helping separate said main jaws upon touchdown of said cargo comprises the addition of an extension coil spring of predetermined strength having one end fastened to the exterior surface of one of said upper portions and its other end fastened to the exterior surface of the lower portion, below the upper portion to which one end of the spring is fastened; thereby, with said spring, said main jaws can open independently of gravity, once tension on said hoist cable relaxes, enabling said device to grab said load cable even in a lying down, flat position.

6. A cargo-hook device in accordance with claim 1, wherein the upper portion of one member being provided with a hole, and wherein a tubular inverted U-shaped standard having two legs to assist the device to remain upright on touchdown is included, said standard passing through said hole in said upper portion and swivelly attached thereto to enable said device to remain upright upon touchdown by the two legs, each of said legs having an end formed by said standard, said legs being bent sufficiently and being of sufficient length on each side of said device's upper portion so that each said end can make contact with said rigid surface when said device releases said load cable upon separation of said main jaws.

7. A tongs-like, cargo-hook device in accordance with claim 1, and wherein said device is suspended from a hovering helicopter, as said device is lowered to a selected load cable; said hoist cable being manually guided to a position over said selected load cable, as said device is approaching said load cable, by a long pole having two ends, said pole having guiding and cable-retention means attached to an end closest to said load cable, said pole's opposite end adapted for being held by a person, said pole having sufficient length for enabling said person to maintain a sufficient distance away from said device to avoid most of the rotor's down wash of said helicopter hovering above, wherein said cable-retention means includes a rectangular-configured tubing having four sides with an opening on one side for entrance of said hoist cable, said tubing to enable said person to manually guide said hoist cable to said selected load cable in any of four horizontal directions, since said helicopter's ability to hover directly over said load cable has limitations in accuracy.

8. A tongs-like, cargo-hook device in accordance with claim 7, and wherein said long pole having a switch and voltage source and wherein said opening on said rectangular-configured tubing having at least one spring-loaded gate with the capability of swinging inward or outward from a closed and aligned position when pushed by a hoist cable, said spring-loaded gate normally in the closed position; said rectangular-configured tubing of sturdy construction; said spring-loaded gate having a solenoid with a plunger and a coil, said plunger, when extended, entering a hole in said tubing adjacent to said gate, with the application of voltage to said coil by closing said switch on said pole, thus providing positive hoist cable retention until said switch is opened allowing said gate to swing open for said hoist-cable to exit.

9. A tongs-like, cargo-hook device suspended from a hovering helicopter, and a long, manually held pole with cable-retention means at one of its two ends for guiding and assisting in quickly scooping up cargo automatically from a platform having a rigid surface, said device comprising a tongs-like part for use with a hoisting mechanism having a hoist cable, said tongs-like part having two elongated members, two hubs and a pivot pin for pivoting together said elongated members approximately midway, each of said members having an inner surface, said hoisting mechanism having hoist cables and said cargo having a steel load cable, said hoist cable being adapted for attachment to said tongs-like part, said elongated members having two upper portions and two lower portions, each of said upper portions having a weight on top to assist in forcing the separation of said portions upon touchdown of said cargo upon said platform; said lower portions, including two main jaws, having complementary, beveled jaw-ends which close against each other, end-to-end, to form a smooth continuous contour when supporting said cargo, because of the tension on said hoist cables; wherein the improvement comprises the addition of a bar magnet having a lower end of predetermined strength, attached vertically to the underside of a first of said two hubs, whereby when said jaws are completely separated from each other, such as at touchdown, said magnet's lower end, when said jaws straddle said load cable, attracting and making contact with the load cable and holding onto the cable until said jaws close, upon lift off of said device; to further assure that said device snatches said load cable, said cable being manually guided by said long pole, having cable-retention means at one end, to a position directly over said selected load cable, said pole having sufficient length to enable a person holding its opposite end to remain a suitable distance away from most of the helicopter rotor's downwash, said bar magnet attracting and making positive contact with said load cable until said jaws close and retain said load cable at said device's lift-off by said hoist cable.

10. A cargo-hook device in accordance with claim 9, wherein said smaller jaws having ends, and wherein said ends of said smaller jaws have a coating of sticky substance to assist in snatching said load cable.

11. A cargo hook device in accordance with claim 9, and wherein said pole has supports with bottom ends for helping to keep said pole at the proper, desired height above said rigid surface and wherein said supports holding up said pole at various heights above said rigid surface to enable said cable-retention means to engage said hoist cable and guide said device over to said load cable, each of said supports swivelly connected to said pole and restrained in horizontal movement, said supports having wheels at said bottom ends to enable easy maneuvering of said pole over said rigid surface.

12. A tongs-like cargo-hook device suspended from a hovering helicopter, for quickly scooping up and releasing cargo, said device comprising a tongs-like part for use with a hoisting mechanism, said tongs-like part having two elongated members, two hubs and a pivot pin for pivoting together said elongated members approximately midway, each of said members having an inner surface, said hoisting mechanism having a hoist cable and said cargo having a non-ferrous load cable, said hoist cable being adapted for attachment to said tongs-like part, said elongated members having two upper portions and two lower portions, each of said upper portions having a weight on top to assist in forcing the separation of said portions upon touchdown of said cargo upon a platform; said lower portions, including two main jaws, having complementary, beveled jaw-ends which close against each other, end-to-end, to form a smooth continuous contour when supporting said cargo, because of the tension on said hoist cables; wherein the improvement in the device's ability to snatch a load cable comprises two additional smaller jaws located within said lower portions, one of said smaller jaws being supported and suspended from the underneath of one of said hubs and the other of said smaller jaws suspended from the other of said hubs, the width of each of said smaller jaws being approximately equal to the width of said lower portions; said smaller jaws being together when said lower portions are completely separated, and said smaller jaws being separated when said lower portions are together and engaged, said load cable having been snatched with the aid of said smaller jaws, then said smaller jaws separating as said device, attached to said cargo by said load cable, is being pulled up by said hoist cable; said smaller jaws improving the ability of said device to scoop up a load cable when said smaller jaws are precisely positioned over said load cable, said cable being of any strong material capable of suspending the weight of said cargo.

13. A tongs-like, cargo-hook device in accordance with claim 12, and wherein said two additional, smaller jaws are provided with means for said load cable to adhere to the inside surfaces of said smaller jaws, said means being a gooey, sticky substance, permanently adhering to said inside surfaces of said smaller jaws, said substance remaining gooey, sticky and resilient on its exterior to temporarily hold on to said load cable, keeping said load cable adhering to one of said smaller jaws until said main jaws close together, upon lift-off of said device and cargo from said platform, whereby without said gooey sticky substance, said load cable would not adhere to the inside surfaces of said smaller jaws, and remain there until said main jaws close together.

* * * * *